US011484462B2

(12) United States Patent
Wright et al.

(10) Patent No.: US 11,484,462 B2
(45) Date of Patent: Nov. 1, 2022

(54) COMPRESSION THERAPY DEVICE WITH MULTIPLE SIMULTANEOUSLY ACTIVE CHAMBERS

(71) Applicant: TACTILE SYSTEMS TECHNOLOGY, INC., Minneapolis, MN (US)

(72) Inventors: Carol L. Wright, Pittsburgh, PA (US); Gregory Yurko, Murrysville, PA (US)

(73) Assignee: TACTILE SYSTEMS TECHNOLOGY, INC., Minneapolis, MN (US)

( * ) Notice: Subject to any disclaimer, the term of this patent is extended or adjusted under 35 U.S.C. 154(b) by 942 days.

(21) Appl. No.: 16/266,511

(22) Filed: Feb. 4, 2019

(65) Prior Publication Data

US 2019/0167509 A1 Jun. 6, 2019

Related U.S. Application Data

(63) Continuation of application No. 13/796,003, filed on Mar. 12, 2013, now Pat. No. 10,195,102.
(Continued)

(51) Int. Cl.
*A61H 9/00* (2006.01)

(52) U.S. Cl.
CPC ..... *A61H 9/0078* (2013.01); *A61H 9/0092* (2013.01); *A61H 2201/0157* (2013.01);
(Continued)

(58) Field of Classification Search
CPC ..... A61H 9/0078; A61H 9/0092; A61H 2201/0103; A61H 2201/5002; A61H 2201/5071; A61H 2209/00
See application file for complete search history.

(56) References Cited

U.S. PATENT DOCUMENTS 3,674,019 A * 7/1972 Grant ..... A61H 9/0078 601/149
3,811,431 A 5/1974 Apstein
(Continued)

FOREIGN PATENT DOCUMENTS

CN 201618095 U 11/2010
DE 19846922 A1 4/2000
(Continued)

OTHER PUBLICATIONS

Motorola, Integrated silicone Pressure Sensor On-Chip Signal Conditions, Temperature Compensated and Calibrated; MPX5050 MPXC5050G Series, 2002.

*Primary Examiner* — Valerie L Woodward
(74) *Attorney, Agent, or Firm* — Mueting Raasch Group

(57) ABSTRACT

Pneumatic and therapeutic compression systems are disclosed including treatment protocols that may be used with such systems. A pneumatic compression system may include a source and sink of a pressurizing fluid. The pressurizing fluid may be sourced to a number of valves, each valve controllable by a control device including a computing device. The computing device may control each valve separately to allow any one or more of the valves to connect to the fluid source or the fluid sink. The computing device may include one or more therapeutic protocols that may direct one, two, or more valves to switch between fluid sourcing and fluid sinking, substantially simultaneously or in a sequence. A therapeutic compression system may include the pneumatic system in fluid communication with an inflation sleeve composed of multiple cells. Each cell may be inflated or deflated by a valve according to the therapeutic protocol.

12 Claims, 7 Drawing Sheets

Related U.S. Application Data

(60) Provisional application No. 61/609,493, filed on Mar. 12, 2012.

(52) U.S. Cl.
CPC ..... *A61H 2201/165* (2013.01); *A61H 2201/5002* (2013.01); *A61H 2201/5007* (2013.01); *A61H 2201/5012* (2013.01); *A61H 2201/5071* (2013.01); *A61H 2201/5097* (2013.01); *A61H 2205/10* (2013.01); *A61H 2209/00* (2013.01)

(56) References Cited

U.S. PATENT DOCUMENTS 4,011,860 A 3/1977 Lee
4,013,069 A 3/1977 Hasty
4,086,920 A 5/1978 Miniere
4,338,923 A 7/1982 Gelfer et al.
4,424,806 A 1/1984 Newman et al.
4,762,121 A 8/1988 Shienfeld
4,773,397 A 9/1988 Wright et al.
4,865,020 A 9/1989 Bullard
4,922,893 A 5/1990 Wright et al.
5,014,681 A 5/1991 Neeman et al.
5,027,797 A * 7/1991 Bullard ..... A61H 9/0078 601/150
5,092,317 A 3/1992 Zelikovski
5,117,812 A 6/1992 McWhorter
5,179,941 A 1/1993 Siemssen et al.
5,186,163 A 2/1993 Dye
5,233,974 A * 8/1993 Senoue ..... A61H 9/0078 601/149
5,263,473 A 11/1993 McWhorter
5,307,791 A 5/1994 Senoue et al.
5,383,842 A 1/1995 Bertini
5,437,610 A 8/1995 Cariapa et al.
5,490,820 A * 2/1996 Schock ..... A61H 31/008 601/1
5,496,262 A 3/1996 Johnson, Jr. et al.
5,554,103 A 9/1996 Zheng et al.
5,571,075 A 11/1996 Bullard
5,575,762 A 11/1996 Peeler et al.
5,584,798 A 12/1996 Fox
5,588,955 A 12/1996 Johnson, Jr. et al.
5,591,200 A 1/1997 Cone et al.
5,611,772 A * 3/1997 Fujimoto ..... A61H 9/0078 601/149
5,795,312 A 8/1998 Dye
5,830,164 A 11/1998 Cone et al.
5,840,049 A 11/1998 Tumey et al.
5,843,007 A 12/1998 McEwen et al.
5,891,065 A 4/1999 Cariapa et al.
5,951,502 A 9/1999 Peeler et al.
5,968,073 A 10/1999 Jacobs
6,007,559 A 12/1999 Arkans
6,010,471 A 1/2000 Ben-Noon
6,080,120 A 6/2000 Sandman et al.
6,123,681 A 9/2000 Brown, III
6,129,688 A 10/2000 Arkans
6,135,116 A 10/2000 Vogel et al.
6,179,796 B1 1/2001 Waldridge
6,231,532 B1 5/2001 Watson et al.
6,234,532 B1 5/2001 Watson et al.
6,290,662 B1 9/2001 Morris et al.
6,296,617 B1 10/2001 Peeler et al.
6,315,745 B1 11/2001 Kloecker
6,406,445 B1 6/2002 Ben-Nun
6,436,064 B1 8/2002 Klocker
6,440,093 B1 8/2002 McEwen et al.
6,494,852 B1 12/2002 Barak et al.
6,544,202 B2 4/2003 McEwen et al.
6,558,338 B1 5/2003 Wasserman
6,585,669 B2 7/2003 Manor et al.
6,645,165 B2 11/2003 Waldridge et al.
6,736,787 B1 5/2004 McEwen et al.
6,786,879 B1 9/2004 Bolam et al.
6,846,295 B1 1/2005 Ben-Nun
6,852,089 B2 2/2005 Kloecker et al.
6,860,862 B2 3/2005 Waldridge et al.
6,884,255 B1 4/2005 Newton
6,893,409 B1 5/2005 Lina
6,945,944 B2 9/2005 Kuiper et al.
6,966,884 B2 11/2005 Waldridge et al.
7,048,702 B2 5/2006 Hui
7,074,200 B1 7/2006 Lewis
7,063,676 B2 8/2006 Barak et al.
7,398,803 B2 7/2008 Newton
7,637,879 B2 12/2009 Barak et al.
7,846,114 B2 12/2010 Webster et al.
7,862,525 B2 1/2011 Carkner et al.
2002/0091345 A1 7/2002 Hazard
2003/0208465 A1 11/2003 Yurko et al.
2004/0059274 A1 3/2004 Kloecker et al.
2004/0171971 A1 9/2004 Ravikumar et al.
2004/0261182 A1 12/2004 Biggie et al.
2005/0154336 A1 7/2005 Kloecker et al.
2005/0222526 A1 10/2005 Perry et al.
2006/0085919 A1* 4/2006 Kramer ..... A61G 7/05776 5/713
2006/0161081 A1 7/2006 Barak et al.
2006/0272719 A1 12/2006 Steinberg
2007/0049853 A1 3/2007 Adams et al.
2007/0088239 A1* 4/2007 Roth ..... A61H 9/0078 601/152
2007/0249976 A1 10/2007 Tucker et al.
2008/0281240 A1* 11/2008 Wright ..... A61H 9/00 601/150
2009/0007341 A1 1/2009 Roff et al.
2009/0056020 A1 3/2009 Caminade et al.
2009/0145234 A1 6/2009 Gasbarro et al.
2012/0065561 A1 3/2012 Ballas et al.
2012/0219432 A1 8/2012 Wright et al.
2012/0277636 A1 11/2012 Blondheim et al.
2013/0125613 A1 5/2013 Grotov
2013/0331748 A1 12/2013 Wright et al.
2014/0052028 A1 2/2014 Wright et al.
2015/0150746 A1 6/2015 Yurko et al.

FOREIGN PATENT DOCUMENTS

FR 2682279 A1 4/1993
GB 2313784 A 10/1997
WO WO 2005/082314 A1 9/2005
WO WO 2007/074451 A2 7/2007
WO WO 2009/076269 A2 6/2009
WO WO 2013/138307 A1 9/2013
WO WO 2014/031409 A1 2/2014
WO WO 2015/084312 A1 6/2015

* cited by examiner

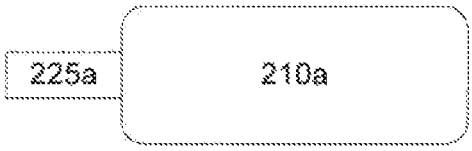
FIG. 2a
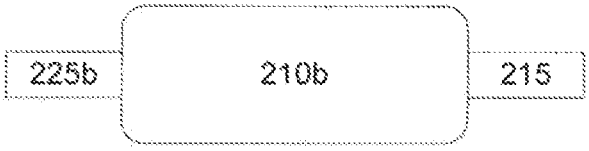
FIG. 2b
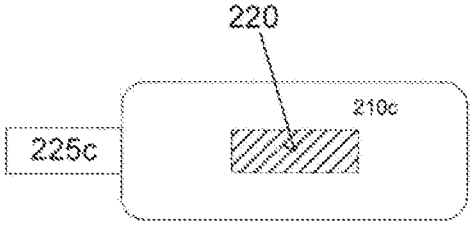
FIG 2c
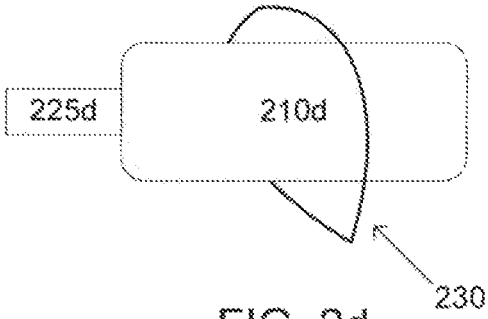
FIG. 2d
FIG. 2

COMPRESSION THERAPY DEVICE WITH MULTIPLE SIMULTANEOUSLY ACTIVE CHAMBERS

CLAIM OF PRIORITY

This application is a continuation application of U.S. patent application Ser. No. 13/796,003 filed Mar. 12, 2013, which claims the benefit of U.S. Provisional Application No. 61/609,493, filed Mar. 12, 2012, the disclosures of which are incorporated by reference herein in their entirety.

BACKGROUND

Diseases such as venous insufficiency and lymphedema can often result in the pooling of bodily fluids in areas of the body distal from the heart. Venous insufficiency can result when the superficial veins of an extremity empty into the deep veins of the lower leg. Normally, the contractions of the calf muscles act as a pump, moving blood into the popliteal vein, the outflow vessel. Failure of this pumping action can occur as a result of muscle weakness, overall chamber size reduction, valvular incompetence and/or outflow obstruction. Each of these conditions can lead to venous stasis and hypertension in the affected area. Lymphedema, which is swelling due to a blockage of the lymph passages, may be caused by lymphatic obstruction, a blockage of the lymph vessels that drain fluid from tissues throughout the body. This is most commonly due to cancer surgery, general surgery, tumors, radiation treatments, trauma and congenital anomalies. Lymphedema is a chronic condition that currently has no cure.

Fluid accumulation can be painful and debilitating if not treated. Fluid accumulation can reduce oxygen transport, interfere with wound healing, provide a medium that support infections, or even result in the loss of a limb if left untreated.

Compression pumps are often used in the treatment of venous insufficiency by moving the accumulated bodily fluids. Such pumps typically include an air compressor that may blow air through tubes to an appliance such as a sleeve or boot containing a number of separately inflatable cells that is fitted over a problem area (such as an extremity or torso). Such pumps may also include pneumatic components adapted to inflate and exhaust the cells, and control circuitry governing the pneumatic components A therapeutic cycle typically involves sequential inflation of the cells to a pre-set pressure in a distal to a proximal order, followed by exhausting all the cells in concert.

While such a compression device may be used in therapy for lymphedema, other pathologies, including venous stasis ulcers, soft tissue injuries, and peripheral arterial disease, and the prevention of deep vein thrombosis may be improved by the use of such a compressor device. However, a therapeutic protocol that may be useful for lymphedema may not be appropriate for other pathologies. Improved systems and methods for implementing and controlling a pneumatic compression device to assist in a variety of therapeutic protocols would be desirable.

SUMMARY

Before the present methods, systems and materials are described, it is to be understood that this disclosure is not limited to the particular methodologies, systems and materials described, as these may vary. It is also to be understood that the terminology used in the description is for the purpose of describing the particular versions or embodiments only, and is not intended to limit the scope.

It must also be noted that as used herein and in the appended claims, the singular forms "a," "an," and "the" include plural references unless the context clearly dictates otherwise. Thus, for example, reference to a "valve" is a reference to one or more valves and equivalents thereof known to those skilled in the art, and so forth. Unless defined otherwise, all technical and scientific terms used herein have the same meanings as commonly understood by one of ordinary skill in the art. Although any methods, materials, and devices similar or equivalent to those described herein can be used in the practice or testing of embodiments, the preferred methods, materials, and devices are now described. All publications mentioned herein are incorporated by reference. Nothing herein is to be construed as an admission that the embodiments described herein are not entitled to antedate such disclosure by virtue of prior invention.

For the purpose of this disclosure, the term "open", when referring to a valve or valve system, may be defined as a state of the valve or valve system in which a structure associated with a first side of the valve is placed in fluid communication with a structure associated with a second side of the valve.

For the purpose of this disclosure, the term "closed", when referring to a valve or valve system, may be defined as a state of the valve or valve system in which a structure associated with a first side of the valve is not placed in fluid communication with a structure associated with a second side of the valve.

In one embodiment, a pneumatic compression system may include a source of a pressurized fluid via a source output, a sink for the pressurized fluid via a sink input, at least one manifold in fluid communication with one or more of the source output and the sink input, multiple valves, each valve having a cell side and a manifold side, one or more cell sensors, in which each cell sensor is associated with the cell side of at least one of the multiple valves, and a computing device capable of communicating with each of the cell sensors and valves. The manifold side of each of the valves may be in fluid communication with one or more manifolds. Further, each valve may assume one of three states: a first state in which the cell side of the valve is in fluid communication with the source output; a second state in which the cell side of the valve is in fluid communication with the sink input; and a third state in which the cell side of the valve is not in fluid communication with either the source output or the sink input. Additionally, a non-transitory, computer-readable storage medium may be in communication with the computing device, along with an input device and an output device. The computer-readable storage medium may contain one or more programming instructions that, when executed, cause the computing device to receive, from the input device, an input related to one or more therapeutic protocols, place at least two of the valves into the first state for a period of time based at least in part on the one or more therapeutic protocols, receive cell sensor data from at least one of the cell sensors, and transmit, to the output device, an output related to the data from at least one of the cell sensors. The one or more therapeutic protocols may include one or more valve activation times, wherein each of the valve activation times is directed toward the activation of at least two valves.

In one embodiment, a therapeutic compression system may include a compression sleeve having a number of inflatable cells, each cell having a cell input, and a pneumatic compression system substantially as disclosed above in which the cell side of each of the valves may be in fluid communication with the input of one of the inflatable cells.

In one embodiment, a therapeutic protocol provided by a therapeutic compression system may include causing at least two inflatable cells to inflate, stopping the inflation of the at least two cells and retaining fluid within each of them, and causing the at least two cells to deflate. The therapeutic compression system may include a compression sleeve having multiple cells, each cell configured to be inflated, deflated, or retain a fluid, and a pneumatic compression system in fluid communication with the cells of the compression sleeve.

BRIEF DESCRIPTION OF THE DRAWINGS

Aspects, features, benefits and advantages of the embodiments described herein will be apparent with regard to the following description, appended claims and accompanying drawings where:

FIGS. 2*a-d* illustrate various embodiments of cells used in a pneumatic compression device in accordance with the present disclosure.

DETAILED DESCRIPTION

Figure 1A:
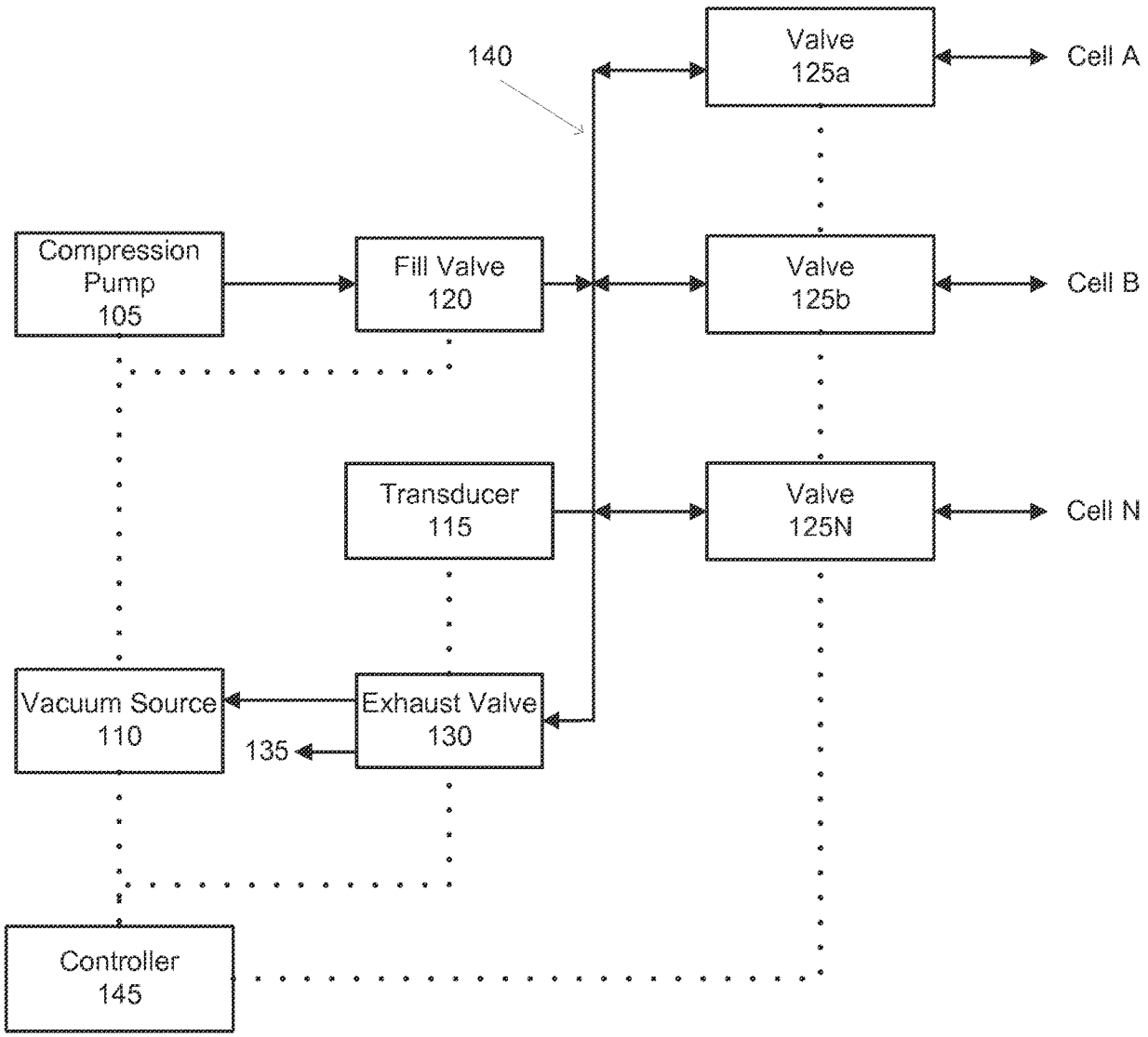
FIGS. 1*a, b* illustrate embodiments of a pneumatic compression device in accordance with the present disclosure.

FIGS. 1*a,b* depict embodiments of a pneumatic compression device. As shown in FIG. 1*a*, the pneumatic compression device may include one or more compression pumps 105, a fill valve 120, a vacuum source 110, an exhaust valve 130, a transducer 115, a controller 145 and a plurality of cell valves, such as 125*a*-N. The compression pump 105 may be used as a source of a pressurized fluid, including, without limitation, air, nitrogen, or water. The fill valve 120 may be in fluid connection with the compression pump 105 through a pressure pump output to receive the pressurized fluid. During an inflation period, the fill valve 120 may open to connect the output of the compression pump 105 to a common node or manifold 140. During a deflation period, exhaust valve 130 may open to connect the common manifold 140 to, for example, a vacuum source 110 to depressurize the cells. Alternatively, exhaust valve 130 may be connected to atmosphere 135. It may be understood that the vacuum source and/or atmosphere may serve as a sink of the pressurizing fluid. One or more inputs to the vacuum or to the atmosphere may be provided. Typically, fill valve 120 and exhaust valve 130 may not be open at the same time. However, some modes of use of the compression device may benefit from the fill valve and exhaust valve being open together. Although FIG. 1*a* illustrates a single exhaust valve 130 capable of connecting to either a vacuum source 110 or the atmosphere 135, it may be appreciated that one exhaust valve may be used to connect the manifold 140 to the vacuum source 110, while a second exhaust valve may be used to connect the manifold 140 to atmosphere 135. Fill valve 120 and exhaust valve 130 may be manually operated, or may be automatically operated by controller 145. Additional fill and/or exhaust valves may be associated with the manifold 140. Each of the cell valves 125*a*-N may be connected to the common manifold 140 on a first side and a corresponding cell on a second side. Additionally, one or more sensors, such as pressure sensors or flow rate sensors, may be on the cell side of the valves. Each cell valve 125*a*-N may be used to selectively connect (in an open configuration) or disconnect (in a closed configuration) the corresponding cell to the common manifold 140. Cell valves 125*a*-N may also be manually operated or automatically operated by controller 145.

The transducer 115 may be connected to and used to monitor the pressure of the common manifold 140. The controller 145 may receive information regarding the pressure detected by the transducer 115 or by any other sensor associated with the cell valves. Based on at least the received pressure information, the controller 145 may determine whether to open or close the fill valve 120, the exhaust valve 130, and/or one or more of the cell valves 125*a*-N.

In an embodiment, illustrated in FIG. 1*a*, the transducer 115 may have a transfer function associated with it which is used to determine the input pressure monitored at the common manifold 140. For example, the transfer function for an MPX5050 transducer manufactured by Motorola may be $V_O=V_S*(0.018*P+0.04)+\text{Offset Error}$, where $V_O$ is the output voltage, $V_S$ is the supply voltage (which may be, for example, approximately 5 Volts), P is the input pressure as measured in kPa, and Offset Error is a static voltage value that is dependent on the process, voltage and temperature of the transducer. Solving for the pressure and combining the Offset Error and $0.04V_S$ term results in the following equation:

$$P(kPa) = \frac{55.6*(V_O - V_{offset})}{V_S} \tag{1}$$

Equation (1) may also be represented in terms of mm Hg by converting 1 kPa to 7.5 mm Hg. The resulting equation is the following:

$$P(\text{mmHg}) = \frac{417*(V_O - V_{offset})}{V_S} \tag{2}$$

The transducer 115 may then be calibrated to determine the pressure based on the output voltage. Initially, $V_{offset}$ may be determined by closing all of the cell valves 125*a*-N and venting the common manifold 140 to the atmosphere 135 via the exhaust valve 130. A value determined by an analog-to-digital (A/D) converter that may either be in communication with or integral to the transducer 115 may be read when the transducer is under atmospheric pressure. The value output by the A/D converter may be an offset value (OFFSET). For a 12-bit A/D converter, OFFSET may be between 0 and 4095.

A scale value (SCALE) may also be determined that corresponds to a scaled source voltage. For example, a precision resistor divide-by-two circuit may be used to divide $V_S$ by 2. The A/D converter may output SCALE based on the $V_S/2$ input value. For a 12-bit A/D converter, SCALE may be a value between 0 and 4095.

Substituting OFFSET and SCALE into Equation (2) results in the following equation:

$$P(\text{mmHg}) = \frac{208.5*(\text{TRANSDUCER_OUTPUT_OFFSET})}{\text{SCALE}}. \tag{3}$$

As such, the offset error and the scale error of the transducer 115 and any errors in the transducer supply voltage may be accounted for by measuring the OFFSET and SCALE values once (for example, at power up).

Alternative transducers potentially having different transfer functions may also be used within the scope of the present disclosure as will be apparent to one of ordinary skill in the art. In addition, one of ordinary skill in the art will recognize that alternate methods of calibrating a transducer may be performed based on the teachings of the present disclosure.

Figure 1B:
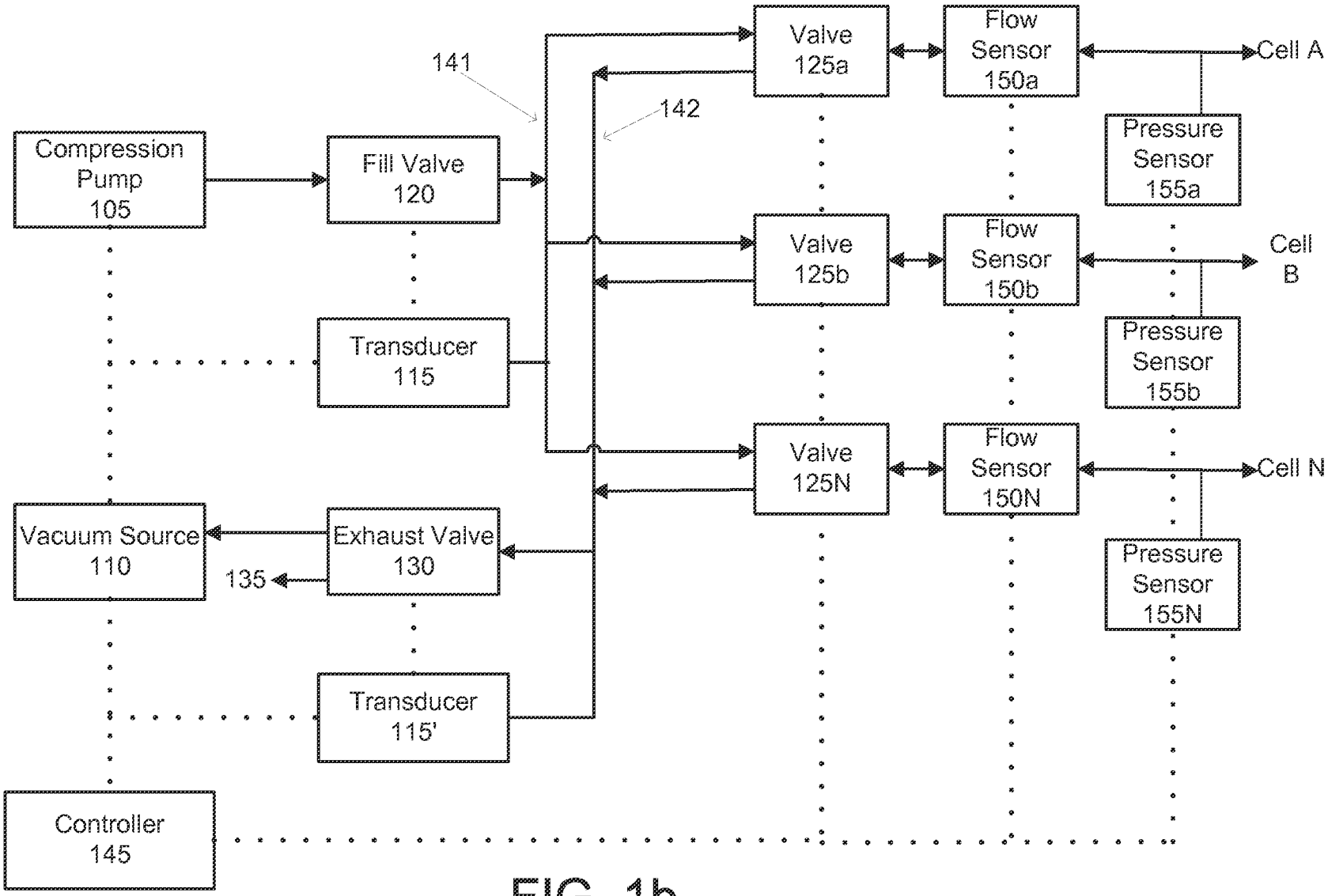

An additional embodiment is illustrated in FIG. 1*b*. In this embodiment, a fill manifold 141 may be associated with the fill valve 120 and compression pump 105. A separate exhaust manifold 142 may be associated with the vacuum source 110 and exhaust valve 130. Cell valves 125*a*-N may be associated with both the fill manifold 141 and exhaust manifold 142. It is understood that cell valves 125*a*-N in this embodiment may have a 3-way function: open to fill, open to exhaust, and closed. In an alternative embodiment, each cell may have a first valve to connect to the fill manifold 141 and a second valve to connect to the exhaust manifold 142. In the dual manifold embodiment in FIG. 1*b*, transducer 115, associated with fill manifold 141, may be calibrated with respect to atmosphere in a manner as disclosed above by means of a separate shunt valve (not shown) associated either directly with transducer 115 or with the fill manifold 141. It may be understood that during the calibration process, fill valve 120 and cell valves 125*a*-N may be closed. Exhaust manifold 142 may also be in communication with its own transducer 115' to monitor the pressure within the exhaust manifold. Transducer 115' may be calibrated with respect to atmosphere in a manner similar to that disclosed above with regards to transducer 115 in FIG. 1*a*. Transducers 115 and 115' may provide sensor data as well to controller 145.

In addition, each valve 125*a*-N may be in fluid connection with a flow sensor 150*a*-N in-line with the connection to its respective cell. Each flow sensor 150*a*-N may be associated with a valve 125*a*-N or with an inflatable cell. Flow sensors 150*a*-N may provide sensor data as well to controller 145. For example, a flow sensor 150*a*-N may be used to monitor that its respective valve 125*a*-N is completely open. If a valve is blocked or otherwise impeded, the fluid flow through it may not match an expected flow profile as determined by controller 145. A flow sensor could provide the controller with data to indicate a fault with the associated valve. The controller may then be programmed to notify a user of the valve flow fault condition. Additionally, the flow sensors may be used to accurately determine the fill/exhaust time for a cell. Based on the data from the flow sensor, the fill/exhaust rate for a cell may be adjusted by controller 145 to control the amount of time required for a fill or exhaust step. A clinician developing a particular therapy protocol may then be able to program a fill or exhaust time as part of the protocol. Such time-based programming may be easier for a clinician to use instead of flow rates and volumes. In addition, the volume of a cell and the fill rate from the flow sensor may allow the controller 145 to detect the presence or absence of a limb in a sleeve or boot incorporating the pressure cells, and may allow the controller the ability to calculate the volume or size of the limb. In one embodiment, a measurement of limb or foot size may be used by the controller for compliance monitoring. In another embodiment, such data may also be used as input to an algorithm for making the compression device more adaptive for different limb sizes Additionally, a pressure sensor 155*a*-N may be associated with each cell to measure the fluid pressure within the cell during its operation. Alternatively, each pressure sensor 155*a*-N may be associated with a respective cell valve 125*a*-N. The pressure sensors 155*a*-N may also provide data to controller 145 so that the controller may be able to control the operation of the compression device. A pressure sensor 155*a*-N associated with its respective cell, may provide direct indication of a pressurization or depressurization profile of the cell. Controller 145 may compare an individual cell pressure against a pre-programmed cell pressure profile. If a cell is unable to sustain an expected pressure, a leak condition may be determined. The controller 145 may then be programmed to notify a user of the leak condition.

Although FIG. 1*a* does not explicitly illustrate the use of either flow or pressure sensors between the valves 125*a*-N and their respective cells, it may be appreciated that either flow sensors, pressure sensors, or both types of sensors may be included in alternative embodiments. Similarly, although FIG. 1*b* illustrates the use of such sensors, it should be understood that other embodiments may lack either one or both types of sensors.

Additional features may be associated with the cells, including, without limitation, volume sensors, inflation sensors, and additional valves. FIGS. 2*a-d* illustrate a number of embodiments of the inflation cells that may be used with the pneumatic compression device. In one embodiment, illustrated in FIG. 2*a*, an inflatable cell 210*a* may be in fluid connection with its cell valve 225*a*. Cell valve 225*a* may be in fluid communication with the manifold 140 as in FIG. 1*a*, or both fill manifold 141 and exhaust manifold 142 as in FIG. 1*b*.

In another embodiment, illustrated in FIG. 2*b*, cell 210*b* may have a cell valve 225*b* also in fluid communication with the manifold 140 as in FIG. 1*a*, or manifolds 141 and 142 as in FIG. 1*b*. In addition, cell 210*b* may have a shunt valve 215 which may be vented to the atmosphere. For example, valve 215 may be used as an emergency release valve in the event that a cell is unable to be exhausted by valve 125 and/or exhaust valve 130. Valve 215 may be manually operated or automatically operated under control of controller 145.

As illustrated in FIG. 2*c*, a cell 210*c* may have a cell valve 225*c* and may also have a strain gage 220 associated with the cell material. Strain gage 220 may be glued or otherwise affixed to the cell, or fabricated as part of the cell, and may be associated with either the inner or outer surface of the cell. The strain gage 220 may be used to measure the deformation of the cell material as it is inflated or deflated, and thereby provide a measure of the volume of fluid within the cell. Although a single strain gage 220 is illustrated, it may be appreciated that multiple strain gages may be associated with each cell to provide accurate data regarding the change in volume or shape of the cell during a therapeutic cycle.

In another embodiment, illustrated in FIG. 2*d*, cell 210*d* may be in fluid communication with valve 225*d*, permitting the cell to have fluid access to the fill and/or exhaust manifold. Cell 210*d* may be fitted with a plethysmograph sensor 230 that may also be used to detect changes in cell shape or volume during a therapeutic cycle. Multiple plethysmograph sensors may be associated with each cell for improved data collection.

Strain gage 220 and plethysmograph sensor 230 may be in data communication with controller 145, thereby providing a point of control feedback to the controller. Although strain gage 220 and plethysmograph sensor 230 are illustrated in FIG. 2, it may be understood that they represent non-limiting examples of sensor systems capable of determining the change in cell shape and/or volume.

The pneumatic compression device may be may be operated to provide a variety of therapeutic protocols. A therapeutic protocol may be defined as a specific sequence of operations to inflate (fill) and deflate (exhaust) one or more cells while they are in contact with a patient. Therapeutic protocols may include, in a non-limiting example, a list of an ordered sequence of cells to be activated, an inflation or deflation pressure threshold value for each cell, an amount of time during cell inflation or deflation, and a phase or lag time between sequential cell activation. In one non-limiting example, the therapeutic protocol may result in the inflation of a plurality of cells substantially simultaneously. In an alternative non-limiting embodiment, the therapeutic protocol may result in the inflation of a plurality of cells in an ordered sequence. It may be understood that an ordered sequence of cells is a sequence of cell inflation over time. In one non-limiting example, the sequentially inflated cells may be physically contiguous in the compression sleeve. In another non-limiting example, the sequentially inflated cells may not be physically contiguous, but may be located in physically separated parts of the compression sleeve. In an additional non-limiting example, the therapeutic protocol may result in stopping the inflation of a plurality of cells substantially simultaneously. In an additional non-limiting example, the therapeutic protocol may result in stopping the inflation of a plurality of cells in an ordered sequence. In some non-limiting examples of a therapeutic protocol, each of a plurality of cells may retain fluid at about the same cell pressure. In some non-limiting examples of a therapeutic protocol, each of a plurality of cells may retain fluid at different pressures. A further non-limiting example of the therapeutic protocol may include deflating a plurality of cells substantially simultaneously. A further non-limiting example of the therapeutic protocol may include deflating a plurality of cells in an ordered sequence. It may be understood that an ordered sequence of cells is a sequence of cell deflation over time. In one non-limiting example, the sequentially deflated cells may be physically contiguous in the compression sleeve. In another non-limiting example, the sequentially deflated cells may not be physically contiguous, but may be located in physically separated parts of the compression sleeve. In yet another non-limiting example of a therapeutic protocol, one of the cells may be inflated and a second cell may be deflated during at least some period of time. As one non-limiting example, one or more cells may be inflated simultaneously as one or more cells are deflated. In another non-limiting example, a first one or more cells may begin inflation and a second one or more cells may begin deflation after the first one or more cells have started inflating. In an alternative non-limiting example, a first one or more cells may begin deflation and a second one or more cells may begin inflation after the first one or more cells have started deflating.

Prior to the start of a therapeutic protocol, an initialization sequence may occur. In one example of an initialization sequence, fill valve 120 may be closed, thereby isolating the compression pump 105 from a manifold (either 140 or 141), and exhaust valve 130 may be opened to atmosphere 135. The cell valves 125*a*-N may then be opened thereby placing each cell in fluid communication with either the common manifold 140 or exhaust manifold 142 thereby allowing all the cells to be vented to atmosphere. Alternatively, exhaust valve 130 may be opened to vacuum source 110 to permit rapid evacuation of the cells. The controller 145 may determine whether a minimum pressure threshold has been reached based on information received from the transducer 115 (for a common manifold configuration) or from transducer 115' (for a dual manifold configuration). The controller 145 may also receive sensor data from the cell specific pressure sensors 155*a*-N. In one embodiment, when the minimum pressure threshold is reached, the controller 145 may send operation commands to exhaust valve 130 to close. In another embodiment, the controller 145 may also provide operation commands to the cell valves 125*a*-N to close. In yet another embodiment, the controller may initiate a therapeutic protocol. It may be appreciated that the initialization sequence may occur while the cells are in contact with the patient, before the cells are affixed onto the patient, or after a protocol has been completed.

A protocol may incorporate one or more cell fill phases. As a non-limiting example of such a fill phase, the following operating sequence may occur. One or more cell valves 125*a*-N may be opened along with the fill valve 120 thereby allowing the one or more cells to be in fluid communication with the compression pump 105. In an embodiment incorporating a common manifold 140, one or more of the cell valves 125*a*-N may open to the common manifold. In an embodiment having independent fill 141 and exhaust 142 manifolds, one or more of the cell valves 125*a*-N may be configured to open the cells to communicate with the fill manifold 141 only. In an embodiment, a cell valve, such as 125*a*, connected to a cell affixed to a distal portion of the patient, may be opened or remain open to the fill 141 or common 140 manifold for inflation while cell valves associated with more proximal cells are closed to that manifold. The cell (e.g. cell A) connected to the open cell valve (e.g. 125*a*) may inflate as a result of being connected to the pressurized fluid from the compression pump 105. The cell pressure may be monitored by the controller 145 via the transducer 115, a pressure sensor 155*a* associated specifically with that cell, or by both.

In an embodiment, the amount of pressure sensed by the transducer 115 may differ from the cell pressure at a particular cell. For example, pressure losses may occur between the transducer 115 and a cell. Accordingly, the controller 145 may access a lookup table to determine the threshold at which the pressure sensed by the transducer 115 is appropriate to close the cell valve 125*a*-N corresponding to the cell.

In another embodiment of a fill phase, an opened cell valve, such as 125*a*, may be modulated to control the fill rate of the corresponding cell. The opened cell valve may be modulated based on time and/or pressure. For example, a cell valve that is being modulated on a time basis may be opened for a first period of time and closed for a second period of time as the cell is inflating. Alternately, a cell valve that is being modulated on a pressure basis may be opened while the cell pressure increases and closed for a period of time during the inflation cycle. The pressure increase may be determined by measuring an initial cell pressure before opening the cell valve and the cell pressure as the cell valve is open. When the difference between the initial cell pressure and the inflating cell pressure is substantially equal to a specific value, the cell valve may be closed. The duty cycle at which the cell valve is modulated may be any value and may be specifically programmed by a user or clinician. The controller 145 may determine when to open and close the cell valve. For pressure-based modulation, any one or more of transducer 115 or cell specific pressure sensors 155 may provide pressure data to the controller 145 to assist in determining when to open and/or close the cell valve during modulation.

Modulation may be performed to ensure that the cell pressure does not increase too quickly for a given protocol. For example, a lymphedema patient may be treated with a protocol requiring slowly inflating and deflating cells. Alternatively, an arterial patient may require a protocol capable of rapid inflation and deflation cycles. Moreover, cells may be of varying size. For example, cells in a device designed for a child may be smaller than cells in a device designed for an adult. However, the compression pump 105 may have a relatively fixed flow rate. As such, modulation may be used to ensure that cell inflation is performed at a proper rate.

In an alternate embodiment, a cell valve, such as 125*a*, may include a variable aperture, which may be used to restrict the rate at which the pressure increases in the corresponding cell. A flow sensor such as 150*a* may monitor the fluid flow rate into the cell. The data from the flow sensor may be provided to controller 145 so that the controller may be able to adjust the aperture in the cell valve. In another embodiment, a cell valve such as 125*a* may incorporate a one-way valve. For example, if valve 125*a* is opened to allow cell A to be filled by common manifold 140 or fill manifold 141, and then valve 125*b* is opened to allow cell B to be pressurized, a one-way valve incorporated in valve 125*a* will prevent transient depressurization of cell A when valve 125*b* is opened to initially evacuated cell B. In another alternate embodiment, a compression pump 105 that operates with a variable flow rate may be used. Additional methods of modulating pressure may also be performed and will be apparent to one of ordinary skill in the art based on this disclosure.

When the cell reaches an appropriate pressure threshold value incorporated as a part of a therapeutic protocol, the controller 145 may close the cell valve 125*a* corresponding to the cell.

A protocol may also incorporate one or more cell exhaust phases. As a non-limiting example of such an exhaust phase, the following operating sequence may occur. One or more cell valves 125*a*-N may be opened along with the exhaust valve 130 thereby allowing the one or more cells to be in fluid communication with either the vacuum source 110, or the atmosphere 135. In an embodiment incorporating a common manifold 140, one or more of the cell valves 125*a*-N may open to the common manifold. In an embodiment having independent fill 141 and exhaust 142 manifolds, the one or more cell valves 125*a*-N may be configured to open the cells to communicate with the exhaust manifold 142 only. In an embodiment, a cell valve, such as 125*a*, connected to a cell affixed to a distal portion of the patient, may be opened or remain open to the exhaust 142 or common 140 manifold for deflation while cell valves associated with more proximal cells are closed to that manifold. The cell (e.g. cell A) connected to the open cell valve (e.g. 125*a*) may deflate as a result of being connected to the vacuum source 110 or atmosphere 135. The cell pressure may be monitored by the controller 145 via transducer 115 for a common manifold configurations or transducer 115' for independent manifold configurations, a pressure sensor 155*a* associated specifically with that cell, or by both.

In an embodiment, the amount of pressure sensed by the transducer 115 or transducer 115' may differ from the cell pressure at a particular cell. For example, pressure losses may occur between the transducer 115 (or 115') and a cell. Accordingly, the controller 145 may access a lookup table to determine the threshold at which the pressure sensed by the transducer 115 (or 115') is appropriate to close the cell valve 125*a*-N corresponding to the cell.

In another embodiment of an exhaust phase, an opened cell valve, such as 125*a*, may be modulated to control the exhaust rate of the corresponding cell. The opened cell valve may be modulated based on time and/or pressure. For example, a cell valve that is being modulated on a time basis may be opened for a first period of time and closed for a second period of time as the cell is deflating. Alternately, a cell valve that is being modulated on a pressure basis may be opened while the cell pressure decreases and closed for a period of time during the exhaust cycle. The pressure decrease may be determined by measuring an initial cell pressure before opening the cell valve and the deflated cell pressure as the cell valve is open. When the difference between the initial cell pressure and the cell pressure is substantially equal to a specific value, the cell valve may be closed. The duty cycle at which the cell valve is modulated may be any value and may be specifically programmed by a user or clinician. The controller 145 may determine when to open and close the cell valve. For pressure-based modulation, any one or more of transducers 115, 115', or cell specific pressure sensors 155 may provide pressure data to the controller 145 to assist in determining when to open and/or close the cell valve during modulation.

Modulation may be performed to ensure that the cell pressure does not decrease too quickly, which could cause a reverse gradient. While a typical pressure gradient may result in distal cells having a greater pressure than proximal cells, a reverse gradient may result in proximal cells having a greater pressure than distal cells. Reverse gradients are frequently considered undesirable, although some therapeutic protocols may make use of them. Moreover, cells may be of varying size. For example, cells in a device designed for a child may be smaller than cells in a device designed for an adult. However, the vacuum source 110 may have a relatively fixed flow rate, and venting to atmosphere 135 may occur due to unregulated, passive exhaust. As such, modulation may be used to ensure that cell deflation is performed at a proper rate.

In an alternate embodiment, a cell valve, such as 125*a*, may include a variable aperture, which may be used to restrict the rate at which the pressure decreases in the corresponding cell. A flow sensor such as 150*a* may monitor the fluid flow rate into the cell. The data from the flow sensor may be provided to controller 145 so that the controller may be able to adjust the aperture in the cell valve. In another embodiment, a cell valve such as 125*a* may incorporate a one-way valve. For example, if valve 125*a* is opened to allow cell A to be evacuated by exhaust manifold 142, and then valve 125*b* is opened to allow cell B to be evacuated, a one-way valve incorporated in valve 125*a* will prevent transient re-pressurization of cell A when valve 125*b* is opened to previously pressurized cell B. In another alternate embodiment, a vacuum source 110 that operates with a variable flow rate may be used. Additional methods of modulating pressure may also be performed and will be apparent to one of ordinary skill in the art based on this disclosure.

When the cell reaches an appropriate pressure threshold incorporated as a part of a therapeutic protocol, the controller 145 may close the cell valve 125*a* corresponding to the cell.

It may be appreciated that a therapeutic protocol may be composed of any variety of sequences of cell inflation and deflation steps. Cells may be inflated and deflated in a specific order, and multiple cells may be inflated or deflated either in synchrony or in a staggered fashion. The cells may be held at a particular inflation or deflation pressure for a specific amount of time. In addition, a specific protocol may be repeated with some lag time between repeats. Alternatively, a first protocol may be followed by a second and different protocol.

In one embodiment of a protocol, a plurality of cell valves 125*a*-N may be opened simultaneously to inflate the plurality of respective cells simultaneously. As the pressure in each cell surpasses a corresponding threshold, the controller 145 may close the cell valve 125*a*-N for the cell. The pressure thresholds for all the cells may be identical or they may differ. For example, the pressure threshold for a cell at a distal position on a patient may be higher than a cell more proximally located. As a result, a pressure gradient may be developed by the cells from a greater pressure at the distal point, to a lesser pressure at the proximal point. The cells may then be deflated simultaneously until they all reach an ambient pressure. Alternatively, only selected cells may be deflated.

In an another embodiment of a protocol, the cell valves 125*a*-N may not be opened simultaneously when the cells are deflated, but rather may be opened in a staggered fashion. In an embodiment based on the common manifold configuration, fill valve 120 may be closed, and exhaust valve 130 may be opened to either the vacuum source 110 or to atmosphere 135. A first cell valve, such as 125*a*, may be opened to release the pressure in the corresponding cell. After a short period of time elapses, a second cell valve, such as 125*b*, may be opened to release the pressure in the corresponding cell. Such a delay time between the deflation of successive cells, may be about 1 second long or longer. In an alternative non-limiting example, the controller 145 may cause a cell valve, such as 125*a* or 125*b*, to release the pressure in the corresponding cell in response to the controller receiving data from a corresponding cell sensor, such as a pressure sensor 155*a* or 155*b*. The controller 145 may cause the pressure in a cell to be released then the sensor data has achieved a therapeutic protocol defined threshold value, such as a maximum pressure. The process may be repeated until each cell valve 125*a*-N has been opened.

In an embodiment of a protocol using modulation, a plurality of cell valves 125*a*-N may be modulated simultaneously. At any given time, one or more cell valves may be opened and/or closed according to a modulation schedule. For example, for a time-based modulation scheme having a 50% duty cycle, half of the cell valves 125*a*-N may be open and half of the cell valves may be closed at any time.

Figure 3:
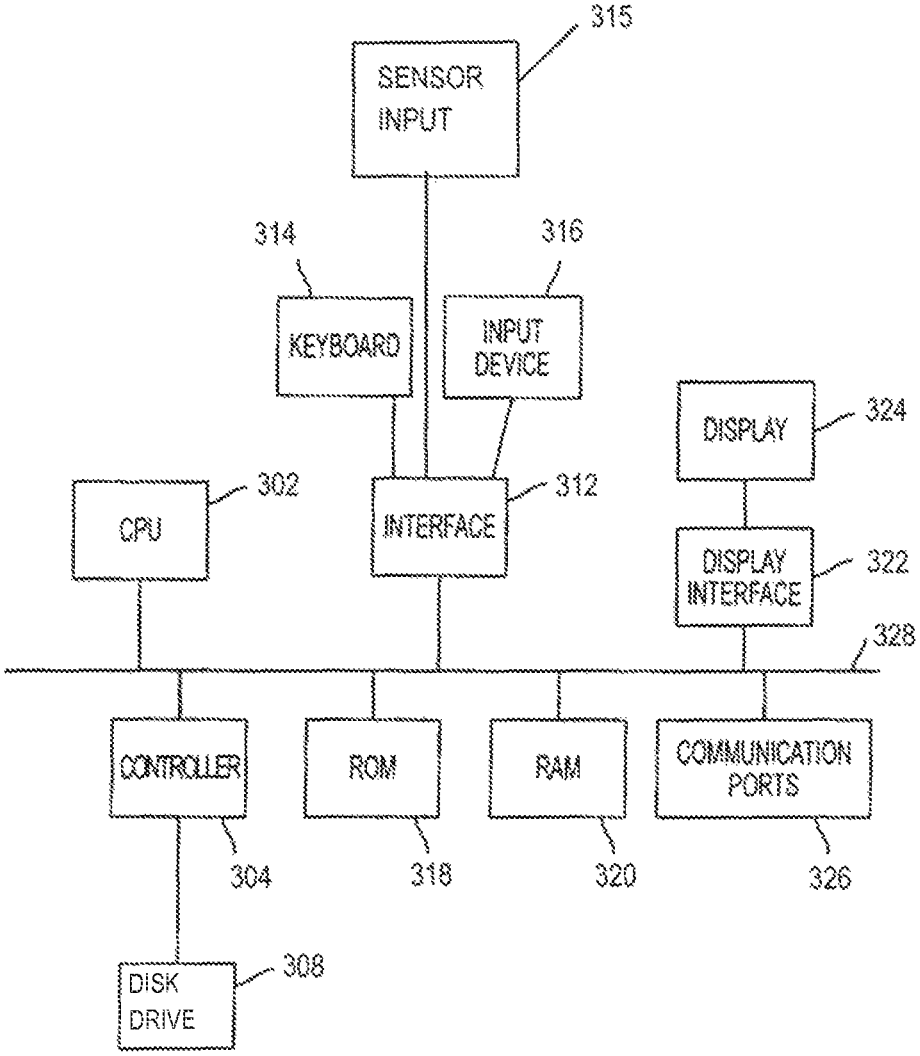
FIG. 3 is a block diagram of an embodiment of hardware that may be used to contain or implement program instructions in accordance with the present disclosure.

FIG. 3 is a block diagram of an embodiment of hardware that may be used to contain or implement program instructions for controller 145. Some or all of the below-described hardware may be incorporated in the controller 145. Referring to FIG. 3, a bus 328 may serve as the main information highway interconnecting the other illustrated components of the hardware. CPU 302 or other computing device is the central processing unit of the system, performing calculations and logic operations required to execute a program. Read only memory (ROM) 318 is one embodiment of a static memory device and random access memory (RAM) 320 is one embodiment of a dynamic memory device.

A controller 304 may interface the system bus 328 with one or more optional disk drives 308. These disk drives may include, for example, external or internal DVD drives, CD ROM drives, or hard drives. Such drives may also be used as non-transitory computer-readable storage devices.

Program instructions may be stored in the ROM 318 and/or the RAM 320. Optionally, program instructions may be stored on a computer readable medium such as a compact disk or a digital disk or other recording medium, a communications signal or a carrier wave. Such program instructions may include a library of pre-loaded therapeutic protocols. Non-limiting examples of such program instructions may cause the controller to receive an input related to one or more therapeutic protocols from an input device, place at least two of the plurality of valves into the first state for a period of time based at least in part on the one or more therapeutic protocols, receive cell sensor data from at least one cell sensor, and transmit, to the output device, an output related to the data from at least one cell sensor. Additional instructions may cause the computing device to place at least two of the plurality of valves in one of the first state and the third state for a period of time based at least in part on data received from at least one cell sensor in operable communication with each of the at least two valves. Additional instructions may cause the computing device to place at least two of the plurality of valves in the first state substantially simultaneously or in an ordered sequence. Further instructions may cause the computing device to place the at least two of the plurality of valves in the third state, either substantially simultaneously or in an ordered sequence. Various instructions may be directed towards receiving sensor data, for example from pressure or flow sensors associated with the valves, and comparing them against appropriate threshold values as included in the therapeutic protocol. Similar instructions may be directed towards placing any of the valves into any of the possible cell states based on the sensor data values and threshold values according the therapeutic protocol.

An optional display interface 322 may permit information from the bus 328 to be displayed on the display 324 in audio, graphic or alphanumeric format. Communication with external devices may occur using various communication ports 326. For example, communication with the fill valve 120, exhaust valve 130, and/or the cell valves 125*a*-N may occur via one or more communication ports 326. Controller 145 may also provide command data over communication ports 326 to valves 120, 130, and 125*a*-N to direct their respective operations.

In addition to the components disclosed above, the hardware may also include an interface 312 which allows for receipt of data from input devices such as a keyboard 314 or other input device 316 such as a mouse, remote control, pointing device and/or joystick. Such input devices may allow a user to choose a pre-programmed therapeutic protocol from a library of such protocols maintained by the controller, enter parameters into a preprogrammed protocol, or enter a new therapeutic protocol into the controller. In addition, transducers 115 and 115', pressure sensors 155*a*-N, flow sensors 150*a*-N, as well as sensors communicating data related to the change in shape or volume of the cells, such as a strain gage 220 and/or a plethysmograph 230, may communicate sensor input 315 through interface 312 to bus 328.

In an embodiment, the controller 145 may store and/or determine settings specific to each cell. For example, the controller 145 may determine one or more pressure thresholds for each cell. Moreover, the controller 145 may prevent the pneumatic compression device from being used improperly by enforcing requirements upon the system. For example, the controller 145 may be programmed so that distal cells in a therapeutic protocol are required to have higher pressure thresholds than proximal cells. The controller may override instructions received from a user via the user interface that do not conform to such pressure threshold requirements. In an embodiment, the pressure thresholds of one or more cells may be adjusted to meet the pressure threshold constraints.

In a further embodiment, controller 145 may provide a compression device user with an interface to permit the user to program the control to provide a variety of therapeutic protocols for patients. The interface may be displayed on the control display, such as a flat panel display. Input devices such as a mouse, keypad, or stylus may be used by the user to provide data to define a particular therapeutic protocol. The controller may record the protocols on a memory or disk device for future use. In one embodiment of the controller, a user may be presented with a list of previously stored therapeutic protocols from which to choose for a particular patient. In another embodiment, a user may define a therapeutic protocol for a patient on an as-needed basis. In another embodiment, a user may choose a stored protocol and modify it. It may be appreciated that such programming may be accomplished through any of a variety of methods. In one non-limiting example, a therapist or other health care professional may enter commands and/or parameters via a keyboard. In another non-limiting example, the therapist or other health care professional may use a mouse or touch screen to select one or more pre-programmed therapeutic protocols or parameters from a menu. In yet another non-limiting example, the therapist or other health care professional may program a protocol with help of a graphical interface presenting therapeutic protocol "primitives." The user may define a therapeutic protocol by selecting a group of graphical primitives representing cells, valves, sensors, and the like, and link them together to form a complete protocol. As one non-limiting example, a final graphical presentation of a therapeutic protocol may be presented on an output device as a flow-chart listing steps, cell inflation order, time between cell inflations/deflations, cell pressure hold parameters, and/or fluid flow rate or pressure thresholds.

In addition to storing protocols, the controller 145 may also record sensor readings obtained during a particular therapy session. Sensor readings may include, without limitation, cell pressures, cell volumes, cell inflation data, and/or air or vacuum air flow values. The controller may also record patient related data such as blood pressure or blood oxygen saturation levels measured during a therapeutic session, as well as a date and time for the session. The controller may also record therapy notes entered by the user.

Although not illustrated in FIG. 3, controller 145 may also include a number of communications interfaces to either a network or a wireless device such as a cell phone, an iPad, a local area network device, and a wide area network device. Such communication interfaces may permit the controller to be monitored remotely by a clinician to obtain performance data or patient compliance data. Such communication interfaces may also permit a remote clinician to program the controller. As one non-limiting example, a physician or technologist may program a new therapeutic protocol in the controller. Alternatively, the care provider may transmit parameter data for a preprogrammed therapeutic protocol, or select a pre-programed therapeutic protocol in the controller. In one embodiment, a cell phone may have an application that may bring up a user-friendly programming interface to permit ease of reprogramming. Alternatively, a remote computer may display a web-enabled display for programming, data assessment, and/or analysis.

A number of possible examples of therapeutic protocols are illustrated schematically in FIGS. 4-9.

Figure 4:
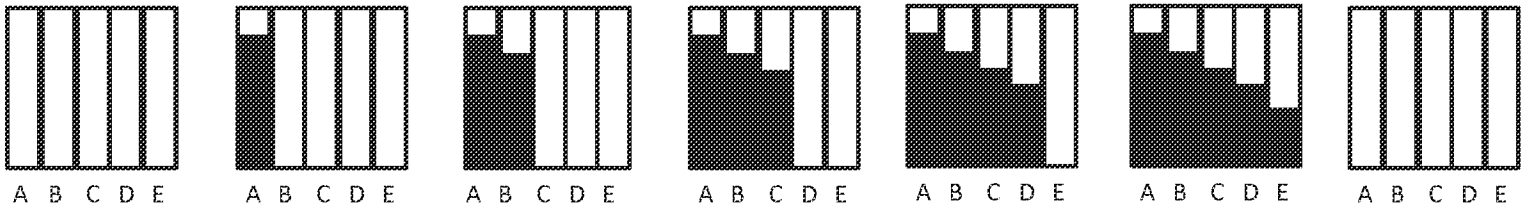
FIGS. 4-9 illustrate a variety of embodiments of therapeutic protocols in accordance with the present disclosure.

An embodiment of a sequential gradient protocol is illustrated in FIG. 4, in which the cells A-E may be arranged distally to proximally on a limb, such as a leg. Initially, all cells A-E may be deflated, FIG. 4*a*. Subsequently, each cell in an ordered sequence may be inflated to a set pressure in an inflation cycle. Thus, cell A may be inflated to a first pressure such as to 60 mmHg, as in FIG. 4*b*, cell B may be inflated to a second pressure (e.g. 50 mmHg) in FIG. 4*c*, cell C may be subsequently inflated to a lower pressure, such as to 40 mmHg, (FIG. 4*d*) followed by cell D (to 30 mmHg, FIG. 4*e*) and cell E (to 20 mmHg, FIG. 4*f*). It may be understood that a successive cell may begin inflation immediately after its preceding cell has been inflated, or there may be a phase delay after a preceding cell has been inflated before the successive cell begins to inflate. In the inflation sequence, the phase delays for each cell may be the same, or different cells may have different phase delays associated with them. The therapeutic protocol may include such phase delay information as part of its parameters. After the entire set of cells has been inflated, they may be simultaneously deflated as illustrated in FIG. 4*g*. The protocol may be repeated as necessary with some rest period between inflation cycles. The cell pressures may be essentially repeated from one cycle to another. Alternatively, a cycle may cause the cells to inflate to a different pressure gradient, such as 70, 60, 50, 40, and 30 mmHg for cells A-E, respectively. It may be appreciated that the final inflation pressure of each cell may differ from all the remaining cells, or all cells may reach essentially the same pressure.

Figure 5:
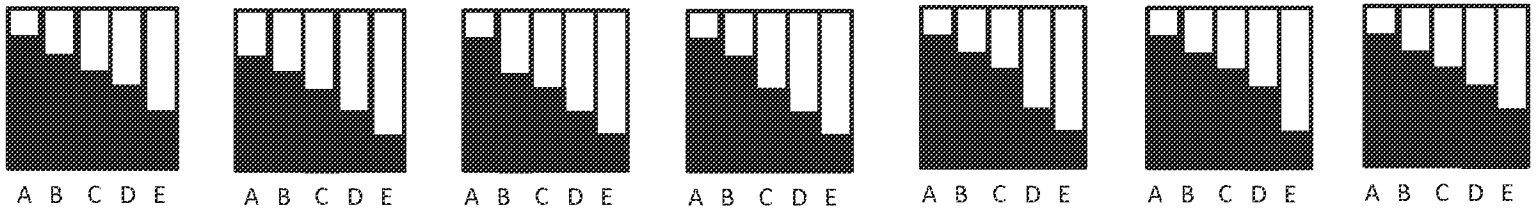

Another embodiment of a sequential inflation cycle is illustrated in FIG. 5. FIG. 5*a* may represent the inflation state of a group of cells after a gradient inflation protocol, as illustrated in FIG. 4*f*. Thereafter, the pressure in all the cells may be reduced by some amount; the resulting cell pressure in each cell may be less than at the start of the protocol, but all the cells may retain some pressure, as in FIG. 5*b*. Thereafter, each cell in succession may be re-pressurized (FIGS. 5*c*-5*f*) until all the cells are re-pressurized to their initial state at the beginning of the protocol, FIG. 5*g*. Cells may be deflated simultaneously or in an ordered sequence. In the case of sequential deflation, It may be understood that a successive cell may begin deflation immediately after its preceding cell has been deflated, or there may be a phase delay after a preceding cell has been deflated before the successive cell begins to deflate. In the deflation sequence, the phase delays for each cell may be the same, or different cells may have different phase delays associated with them. The therapeutic protocol may include such phase delay information as part of its parameters.

Figure 6:
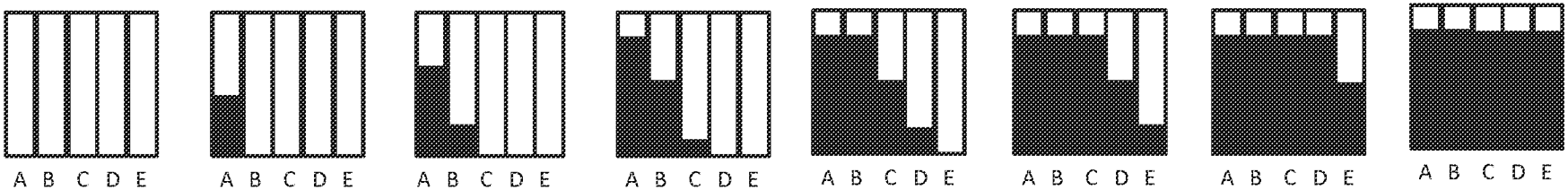

FIG. 6 illustrates another embodiment of a rapid toggle protocol. Initially, all the cells may be deflated in as FIG. 6*a*. Thereafter, cell A may begin inflating to some pressure, FIG. 6*b*. Cell A may continue to inflate, but cell B may begin to inflate after cell A reaches a threshold pressure (FIG. 6*c*). As illustrated in FIG. 6*d*, cell A may continue pressurizing to some final value. Meanwhile, as cell B pressurizes past a threshold value, cell C may then begin to inflate. The sequence may continue (FIGS. 6*e*-6*g*), in which a cell begins to inflate when a preceding cell inflates to a particular pressure threshold. It is understood that the thresholds for all the cells may be essentially the same. Alternatively, one or more cells may have different thresholds. In one embodiment, the thresholds may be programmed by a therapist operating the compression therapy device. In another embodiment, a user or patient receiving the compression therapy may program the thresholds. In addition, although FIG. 6 illustrates that the final pressures attained by all the cells are effectively identical, it may be appreciated that the final pressures attained by the cells may form a pressure gradient as illustrated in FIG. 4*f*.

Figure 7:
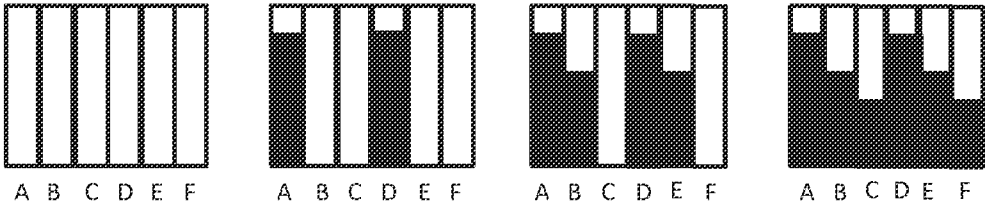

FIG. 7 illustrates yet another therapeutic protocol. In this protocol, an even number of cells may be employed. When the protocol begins, all the cells may be in a deflated state (FIG. 7*a*). Thereafter, a pair of cells, such as cells A and D may inflate simultaneously (FIG. 7*b*) until they reach their final pressures. The next cells, B and E, may then be inflated (FIG. 7*c*) until they reach their final pressures. Thereafter, the final cells, D and F may be inflated (FIG. 7*d*). It may be appreciated that cells B and E may begin to inflate before cells A and D finish inflating, and similarly cells C and F may begin their inflation cycle before cells B and E attain their final pressures. After the protocol is completed (FIG. 7*d*) all the cells may deflate simultaneously, or in some other order as required.

Figure 8:
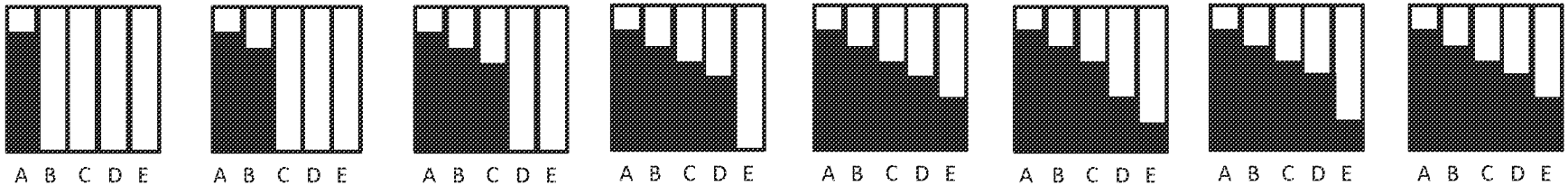

In another example of a therapeutic protocol, FIG. 8 illustrates what may be termed a "milking" protocol. FIGS. 8*a*-8*e* illustrate a gradient inflation protocol similar to that illustrated in FIGS. 4*b*-4*f*. Instead of deflating all cells as in FIG. 4*g*, the protocol may allow cells A, B, and C to retain their pressures, while only cells D and E partially deflate to lower pressures (FIG. 8*f*). Thereafter, in sequence, cell D (FIG. 8*g*) and E (FIG. 8*h*) may re-inflate to their previous pressures (FIG. 8*h*). The protocol may then repeat the steps illustrated in FIGS. 8*f*-*h*.

Figure 9:
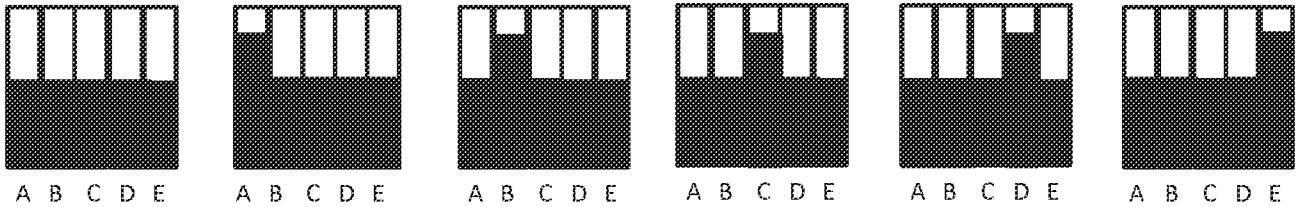

In yet another example of a therapeutic protocol, the cells may inflate in a "wave" motion (FIG. 9). In one simple protocol, the cells may be partially inflated to some pressure (FIG. 9*a*). Although all cells are represented as having about the same pressure, it may be appreciated that the cells may be initially inflated into a gradient as illustrated in FIG. 8*e*. Thereafter, one cell at a time may be increased in pressure, Cell A (distal) through cell E (proximal) according to the sequence in FIGS. 9*b*-9*f*. Although the protocol illustrated in FIG. 9 illustrates a single cell inflating at a time, it is understood that a more effective therapy may include inflating a more proximal cell while its neighboring more distal cell is inflated, and then deflating the distal neighbor after the proximal cell is fully inflated. As an example, after cell A is fully inflated (FIG. 9*b*), cell B may be inflated. Thereafter, after cell B has been inflated, cell A may be deflated back to its prior pressure resulting in the state illustrated in FIG. 9*c*.

It may be understood that the protocols illustrated in FIGS. 4-9 represent a few examples of possible inflation/deflation protocols. Other protocols may include more or fewer cells, and a variety of sequences of inflation and deflation.

More complex therapeutic protocols may include feedback from the individual cells to the controller 145 before, during, and/or after inflation or deflation. In one non-limiting example, the controller 145 may monitor the pressure of a cell after it has stopped inflating or deflating to assure the cell pressure is maintained while the cell is in a hold state (neither inflating nor deflating). Thus, the pressure measured by a pressure sensor 155*a* associated with a first cell may change due to effects on the tissue brought about by the inflation of a neighboring cell. The controller 145 may respond to the change in pressure in the first cell by activating its associated valve 125*a* to adjust the first cell pressure to a desired value.

In another protocol, the controller 145 may retain or have access to logs associated with the patient's medical history over time. Such historical data may be used by the controller 145 or a health care professional to modify a protocol to account for a change in the patient's status. As one non-limiting example, the controller 145 may alter a patient's usual therapeutic protocol if the long term patient status—as recorded in the patient logs—indicates an improvement over time. Alternatively, if the patient does not improve, the controller 145 may alter the usual patient's protocol in an attempt to improve its effectiveness. A health care provider may also be presented with such long term status information along with a recommendation for a protocol change by the controller 145. The health care provider may then accept the recommendation by the controller 145, or may make additional modifications.

In one non-limiting embodiment, the pneumatic compression device may be portable. In an embodiment, the pneumatic compression device may include a user interface that enables the user to interact with the controller 145. For example, the user interface may include a display and one or more input devices, such as a keypad, a keyboard, a mouse, a trackball, a light source and light sensor, a touch screen interface and/or the like. The one or more input devices may be used to provide information to the controller 145, which may use the information to determine how to control the fill valve 120, exhaust valve 130, and/or the cell valves 125*a*-N.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

What is claimed is:

1. A therapeutic compression system comprising:
- a plurality of inflatable cells; and
- a pneumatic compression system operatively coupled to the plurality of inflatable cells and comprising:
  - a source of a pressurized fluid to selectively inflate one or more of the plurality of inflatable cells,
  - a sink to selectively deflate one or more of the plurality of inflatable cells,
  - a manifold to be in fluid communication with the source, the sink, and the plurality of inflatable cells,
  - a plurality of valves operatively coupled to the manifold to selectively inflate, deflate, or hold the pressure of each of the plurality of inflatable cells,
  - a computing device in operable communication with the source and the plurality of valves and configured to:
    - provide compression therapy to a user using the plurality of inflatable cells according to a plurality of therapeutic protocols, wherein each therapeutic protocol of the plurality of therapeutic protocols comprises an ordered sequence of inflation and deflation of the plurality of inflatable cells,
    - wherein a first therapeutic protocol of the plurality of therapeutic protocols provides:
      - simultaneous inflation of a first cell and a second cell of the plurality of inflatable cells using the plurality of valves for a first period of time, wherein the first cell is not physically contiguous with the second cell, and
      - simultaneous inflation of a third cell and a fourth cell of the plurality of inflatable cells using the plurality of valves for a second period of time following the first period of time, wherein the third cell is not physically contiguous with the fourth cell,
    - wherein the plurality of therapeutic protocols comprises a second therapeutic protocol different from the first therapeutic protocol, wherein the second therapeutic protocol provides:
      - maintenance of a minimum pressure in each of the plurality of inflatable cells, and
      - sequential inflation of each of the plurality of inflatable cells, one at a time, to a selected pressure greater than the minimum pressure.

2. The system of claim 1, wherein the first therapeutic protocol further provides simultaneous inflation of a fifth cell and a sixth cell of the plurality of inflatable cells using the plurality of valves for a third period of time following the second period of time.

3. The system of claim 1, wherein the first therapeutic protocol further provides simultaneous deflation of the first cell and the second cell of the plurality of inflatable cells using the plurality of valves during the second period of time.

4. The system of claim 1, wherein the first cell is physically contiguous with the third cell and the second cell is physically contiguous with the fourth cell.

5. The system of claim 1, wherein the plurality of inflatable cells are arranged from a most distal cell to a most proximal cell, wherein sequential inflation of each of the plurality of inflatable cells, one at a time, to a selected pressure greater than the minimum pressure comprises sequentially inflating each of the plurality of inflatable cells from the most distal cell to the most proximal cell.

6. The system of claim 1, wherein the computing device is further configured to allow the user to select which of the plurality of therapeutic protocols to be provided to the user.

7. The system of claim 1, wherein the computing device is further configured to allow the user to modify at least one of the plurality of therapeutic protocols.

8. A therapeutic compression system comprising:
- a source of a pressurized fluid to selectively inflate one or more of a plurality of inflatable cells;
- a sink to selectively deflate one or more of the plurality of inflatable cells;
- a manifold to be in fluid communication with the source, the sink, and the plurality of inflatable cells;
- a computing device in operable communication with the source and a plurality of valves and configured to:
  - provide compression therapy to a user using the plurality of inflatable cells according to a plurality of therapeutic protocols, wherein each therapeutic protocol of the plurality of therapeutic protocols comprises an ordered sequence of inflation and deflation of the plurality of inflatable cells, wherein a first therapeutic protocol of the plurality of therapeutic protocols provides:

simultaneous inflation of a first cell and a second cell of the plurality of inflatable cells using the plurality of valves for a first period of time, wherein the first cell is not physically contiguous with the second cell, simultaneous inflation of a third cell and a fourth cell of the plurality of inflatable cells using the plurality of valves for a second period of time following the first period of time, wherein the third cell is not physically contiguous with the fourth cell, and wherein the third and fourth cells of the plurality of inflatable cells are next cells to inflate after the first and second cells, and simultaneous deflation of the first cell and the second cell of the plurality of inflatable cells using the plurality of valves during the second period of time.

9. A therapeutic compression system comprising:

a plurality of inflatable cells; and a pneumatic compression system operatively coupled to the plurality of inflatable cells and comprising:

a source of a pressurized fluid to selectively inflate one or more of the plurality of inflatable cells, a sink to selectively deflate one or more of the plurality of inflatable cells, a manifold to be in fluid communication with the source, the sink, and the plurality of inflatable cells, a plurality of valves operatively coupled to the manifold to selectively inflate, deflate, or hold the pressure of each of the plurality of inflatable cells, a computing device operatively coupled to the source and the plurality of valves and configured to:

for each pair of non-physically contiguous inflatable cells of the plurality of cells, one pair at a time, simultaneously inflate the pair of non-physically contiguous inflatable cells of the plurality of cells for a period of time and simultaneously deflate the pair of non-physically contiguous inflatable cells of the plurality of cells following the expiration of the period of time until all of the plurality of cells have been inflated and deflated.

10. The system of claim 9, wherein the plurality of inflatable cells are arranged from a most distal cell to a most proximal cell and define a proximal group of inflatable cells and a distal group of inflatable cells, wherein the proximal group of inflatable cells are more proximal than the distal group of inflatable cells, wherein each pair of non-physically contiguous inflatable cells of the plurality of cells comprises a single inflatable cell from the proximal group different from any other pair and a single cell from the distal group different from any other pair.

11. The system of claim 9, wherein the plurality of inflatable cells are arranged from a most distal cell to a most proximal cell and define a proximal group of inflatable cells and a distal group of inflatable cells, wherein an initial pair of non-physically contiguous inflatable cells that are simultaneously inflated and deflated comprise the most distal cell and a most distal cell of the proximal group.

12. The system of claim 11, wherein a next pair of non-physically contiguous inflatable cells following the inflation and deflation of the initial pair of non-physically contiguous inflatable cells are physically contiguous with initial pair of non-physically contiguous inflatable cells.

* * * * *